US007389819B2

(12) United States Patent
Oyeneyin et al.

(10) Patent No.: US 7,389,819 B2
(45) Date of Patent: Jun. 24, 2008

(54) WELL SCREEN

(75) Inventors: Mufutau Babs Oyeneyin, Edinburgh (GB); Asher Mahmood, Wokingham (GB)

(73) Assignee: Robert Gordon University, Schoolhill, Aberdeen (GB)

( * ) Notice: Subject to any disclaimer, the term of this patent is extended or adjusted under 35 U.S.C. 154(b) by 283 days.

(21) Appl. No.: 10/526,887

(22) PCT Filed: Sep. 8, 2003

(86) PCT No.: PCT/GB03/03896

§ 371 (c)(1),
(2), (4) Date: Oct. 12, 2005

(87) PCT Pub. No.: WO2004/022912

PCT Pub. Date: Mar. 18, 2004

(65) Prior Publication Data

US 2006/0144596 A1 Jul. 6, 2006

(30) Foreign Application Priority Data

Sep. 7, 2002 (GB) ..... 0220838.7

(51) Int. Cl.
*E21B 43/12* (2006.01)
*E21B 34/06* (2006.01)

(52) U.S. Cl. ..... 166/373; 166/205; 166/233; 166/386

(58) Field of Classification Search ..... None
See application file for complete search history.

(56) References Cited

U.S. PATENT DOCUMENTS

| | | | | |
|---|---|---|---|---|
| 419,606 | A | 1/1890 | Jewell | |
| 2,280,054 | A | 4/1942 | Beck | |
| 2,681,111 | A | 6/1954 | Thompson | |
| 3,638,726 | A | 2/1972 | Sibley | |
| 3,993,130 | A | 11/1976 | Papp | |
| 4,691,778 | A | 9/1987 | Pyne | |
| 5,803,179 | A * | 9/1998 | Echols et al. | 166/370 |
| 5,979,551 | A | 11/1999 | Uban et al. | |

* cited by examiner

*Primary Examiner*—Zakiya W. Bates
(74) *Attorney, Agent, or Firm*—Drinker Biddle & Reath LLP.

(57) ABSTRACT

A screen system for underground wells, and a method of fluid flow control and/or sand production control in a well. The screen system may include an inner screen and an outer screen having a plurality of slots. A mechanism, which may include a motor, is provided to vary the size of the said slots, and may achieve this by rotating one end of the inner screen relative to the other end. An external screen shroud may also be provided and the rotatable mechanism may be controlled by a controller coupled to electromechanical sensors mounted on one or more portions of the screen system, where the controller may employ a solids prediction model and a plugging tendency model to calculate a control action.

21 Claims, 3 Drawing Sheets

WELL SCREEN

Figure 1A:
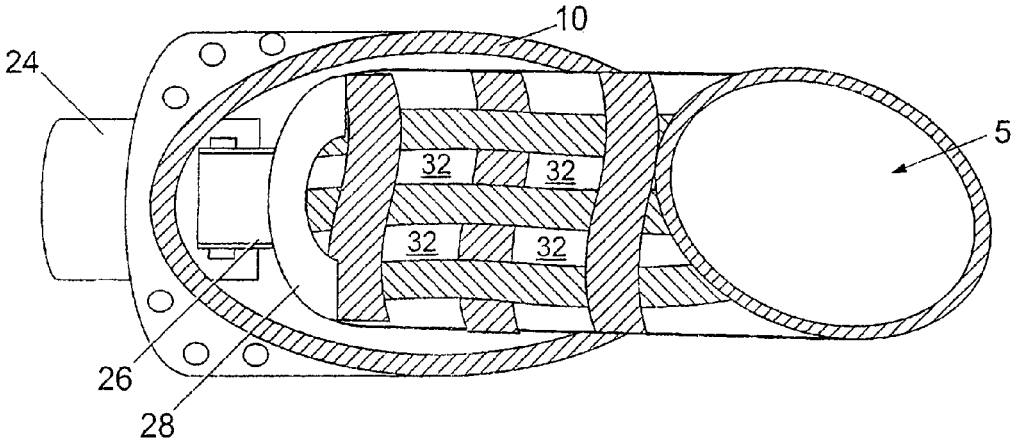

This Application is the U.S. National Phase Application of PCT International Application No PCT/GB2003/003896 filed Sep. 8, 2003.

This invention relates to a screen and in particular a screen for use in oil and gas wells.

More than 80% of oil and gas clastic reservoirs world-wide are known to be in various stages of unconsolidation which may potentially cause the reservoir to produce sand. This is especially true for reservoirs located in deep waters. Similarly, many of the reservoirs in mature fields are in an advanced state of depressurisation, which makes them susceptible to sand failure. Consequently, at various stages in the economic life of a field, a reservoir located therein will generally require some form of sand control completion. To this end, there is currently an increasing trend towards the use of different screen systems (either barefoot in openhole completions or gravelpack screens) in the completion of wells drilled through reservoirs with sanding problems.

In an attempt to improve oil or gas recovery at minimal cost from marginal and mature fields, horizontal, extended reach and multilateral wells are becoming the most popular advanced wells for optimal field developments; especially in challenging deep water High Pressure/High Temperature (HP/HT) environments like the Atlantic margin. Sand control in these wells with screen systems (with or without gravelpack), involves placing the selected screen in the well bore within a pay region specifically designed to allow reservoir fluids to flow through the screen slots whilst enabling the screen to filter out formation sand grains. A key part of the screen design therefore is the screen slot gauge, wherein this parameter is estimated by way of the formation grain size distribution. However, any solids loading or sand migration through the slots may lead to plugging and screen erosion with attendant downhole problems including sand production.

A variety of different generic screen systems are currently in use in the oil industry, such as simple slotted liners, wire wrapped and pre-packed screens, excluder, equalising and conslot screens and special strata pack membrane screens. These screens characteristically have symmetric, fixed geometry slots. However, when these screens are used in advanced wells, the screens are subjected to a non-uniform particulate plugging profile which results in "hotspots" developing in the screen; this is a major concern because it causes erosion of the screen resulting in massive sand production. Follow-up workover operations of such screens are limited to in situ acid washes or vibration or insertion of a secondary slim screen (such as stratacoil) into the damaged screen, which has an adverse affect on reservoir inflow and well performance. Also, retrieval of damaged screens from specially extended-reach wells is almost impossible. Consequently, in adverse conditions, some wells have been abandoned and expensive side-tracks drilled.

The main difference between the various screen systems currently in use resides in the geometry or configuration of the rigid screen shroud with its fixed, symmetric slots. These systems have different degrees of susceptibility to plugging and operations engineers are usually left with the problem of selecting the most appropriate screen systems to use for specific sand control completions from the range of screen systems currently available.

Previous work by investigators has shown that the stability and bridging effectiveness of typical filtration media such as screen systems or gravelpacks are functions of operational, environmental and geometric parameters which are largely dependant on the following:

Formation grain sized distribution and sorting;

Type of reservoir fluids and fluid properties;

Reservoir drawdown and production; and

The geometry of the filtration medium.

Thus for a defined operating and production rate and drawdown condition, a clastic unconsolidated reservoir will produce sand grains of a particular size distribution which is dependant on the reservoir characteristics. Thus the amount and size distribution of solids contained in a given barrel of fluid produced from an oil or gas well, depends on the bridging effectiveness of the filtration media used in the wells, wherein the bridging effectiveness can be evaluated for defined operational conditions.

According to the invention there is provided a screen system for underground wells, the screen system comprising a screen:

wherein the screen comprises a plurality of slots; and a mechanism capable of varying the size of the said slots.

According to the invention there is provided a method of fluid flow control and/or sand production control in a well, the method comprising the steps of placing a screen having a plurality of slots in the well and varying the size of the slots.

Preferably, the screen system comprises a pair of screens comprising a slotted inner screen disposed within a slotted outer screen. Optionally, at least one screen shroud is further provided which is attachable to the outer screen.

Typically, the inner screen is rotatable relative to the outer screen. Preferably, the inner screen comprises a substantially cylindrical member having a pair of ends wherein one end is rotatable relative to the other end by operation of the said mechanism. Typically, the mechanism comprises a motorised actuator.

Preferably, the screen comprises a plurality of longitudinally arranged members and at least one transversely arranged member which combine to provide the slots in the interstices therebetween, wherein, rotation of one end of the screen causes an end of the longitudinally arranged members to rotate relative to the other end of the longitudinally arranged members such that the slot size is capable of being varied.

Preferably at least one screen shroud is provided with electromechanical sensors.

Preferably, the inner screen is rotated under the control of a controller which is further connected to the electromechanical sensors.

Preferably the controller employs a solids predict-on model to calculate a control action.

Preferably the controller further employs a plugging tendency model to calculate a control action.

According to a second aspect of the invention, the screen system is further provided with an external screen shroud.

Preferably, the external screen shroud is perforated.

Figure 1B:
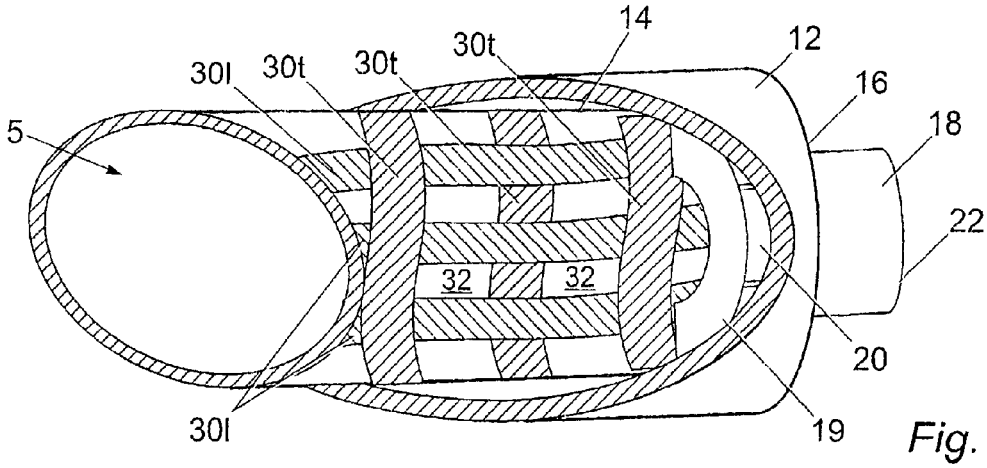
Figure 2:
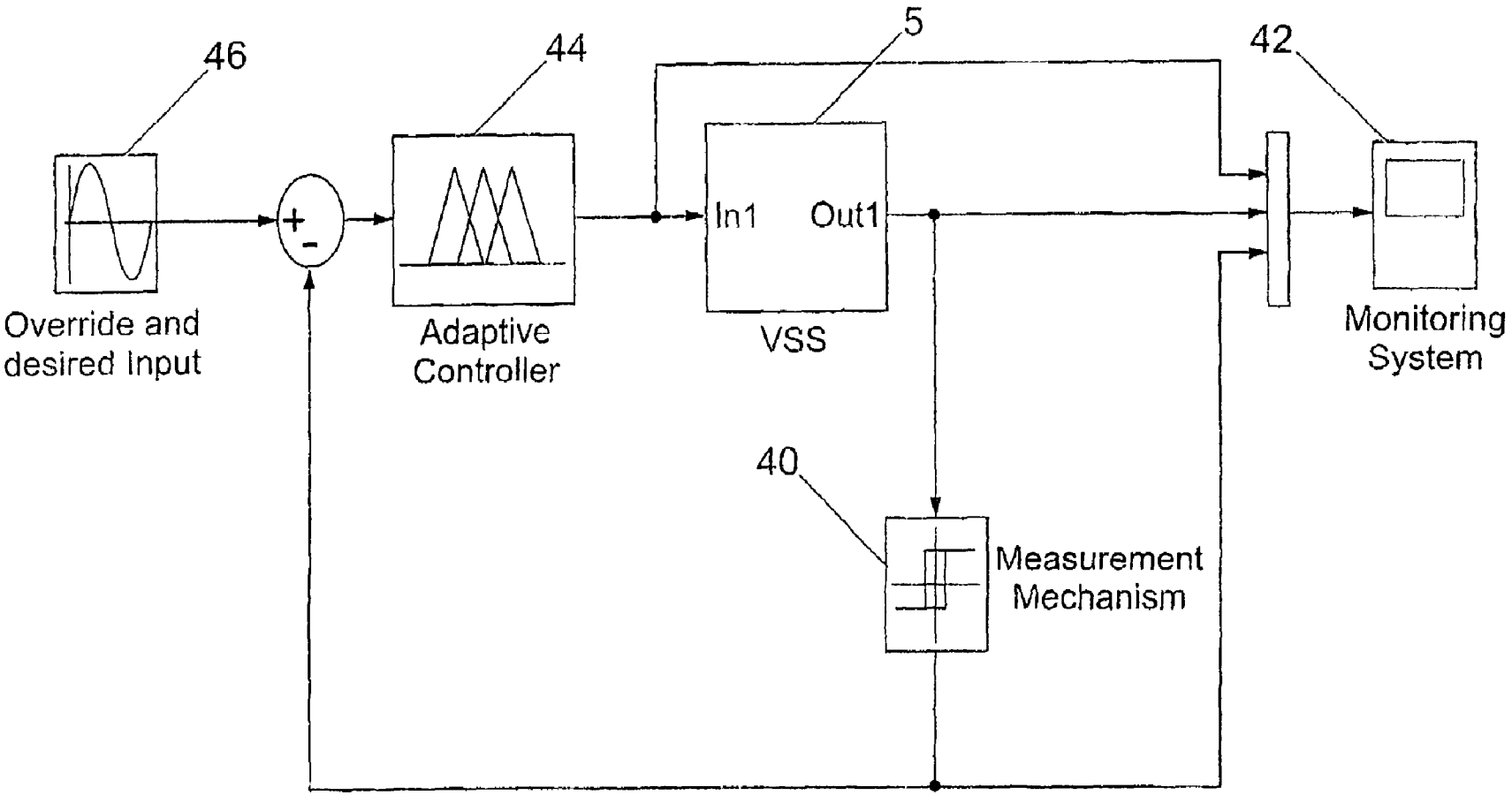
Figure 3:
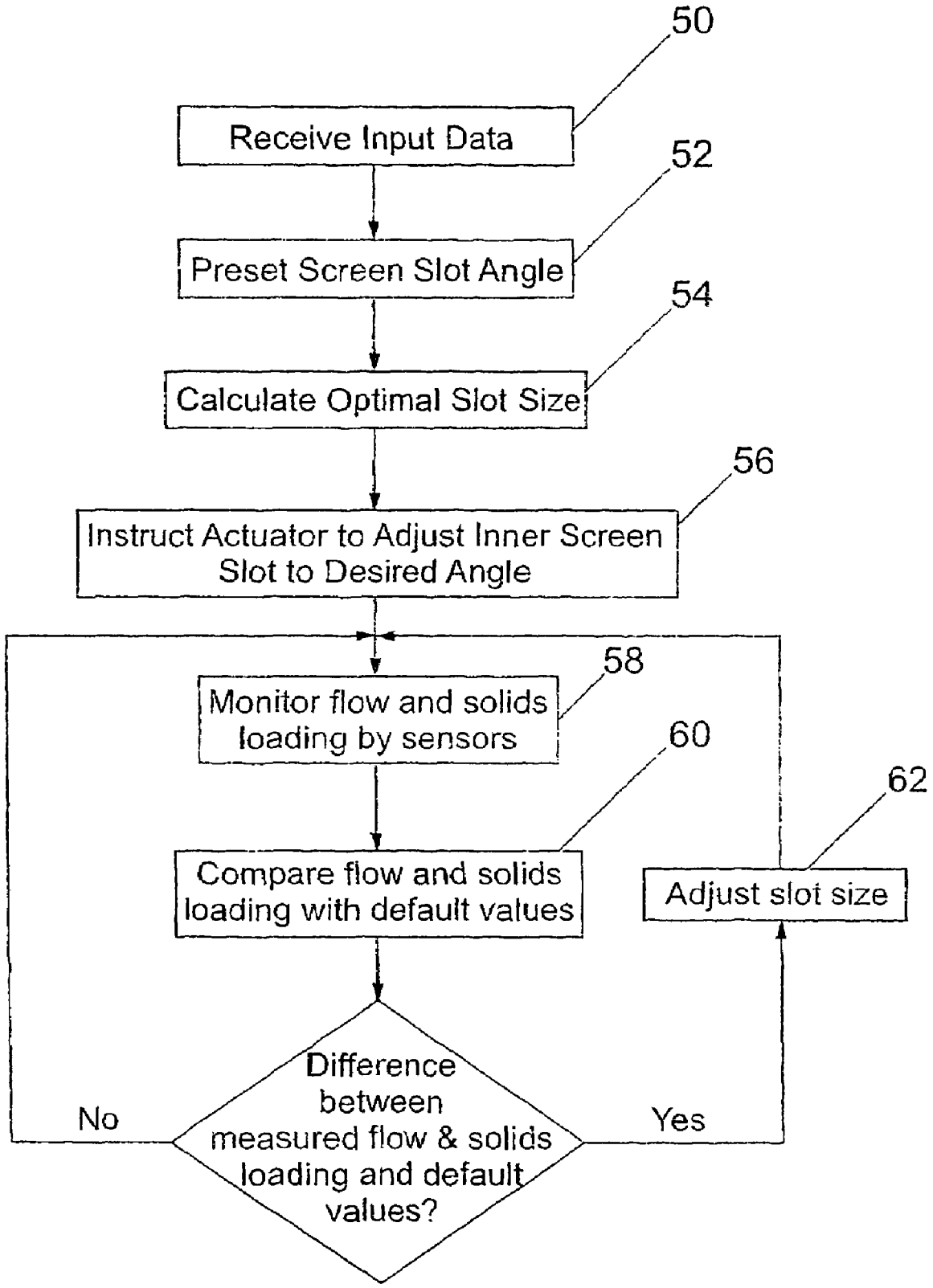

Embodiments of the present invention will be described by way of example only, with reference to the accompanying drawings, in which:

FIG. 1*a* is a side elevation of a bottom section of the screen system, in accordance with the present invention, highlighting a protective shroud, an inner screen and base of the screen, without showing an outer screen;

FIG. 1*b* is a side elevation of an upper section of the screen of FIG. 1*a*, highlighting the outer and inner screen without showing the protective shroud;

FIG. 2 is a block diagram of an architecture for a system for controlling the slot angle of the screen system of FIGS. 1*a* and 1*b*; and FIG. 3 is a flow chart showing the different stages in the process of controlling the slot angle of the screen system of FIGS. 1*a* and 1*b*.

Referring to FIG. 1*a*, a screen system 5 is shown for use in underground wells such as oil and gas wells (not shown), and is provided with an optional external protective shroud 10 substantially comprised of a high grade steel perforated pipe. The external protective shroud 10 acts as a blast protector and helps support any unconsolidated reservoir sand collapse around the screen system 5. The external protective shroud 10 is provided with a high density of perforations of large diameter, this feature minimises the development of any potential hotspots in the screen and provides a maximum area for fluids to flow through.

In a second embodiment of the invention, the screen system 5 does not require an outer protective shroud 10 and is used with a drill-in Liner (DIL) pre-installed within the well.

Referring to FIG. 1*b*, the shroud 10 (not shown in FIG. 1*b*) encases two concentric slotted screens 12 and 14, namely a rigid outer screen 12 and an inner screen 14 wherein the inner screen 14 is telescopically moveable relative to the outer screen 12.

A first end 16, in use upper end 16, of the outer screen 12 is provided with an aperture (not shown) through which a quick connect joint 18 extends. The quick connect joint 18 is sufficiently wide to fill the aperture.

A first end 19 of the inner screen 14 is provided with a rigid drive shaft 20 which is latchable onto a first end (not shown), in use lower end, of the quick connect joint 18. A second end 22 of the quick connect joint 18 is connectable to a hydraulic motordrive shaft (not shown) or electrohydraulic or electromagnetic actuator via a second quick connect joint to actuate or turn the upper end 19 of the inner screen 14 to a specified angle.

The quick connect joints at each end of the outer screen 12 have bearings that permit rotation of the inner screen 14. The inner screen 14 is driven by means of the drive shaft 20 at the upper end of the outer screen 12, which is urged by the electromagnetic/electrohydraulic actuator A swivel base 24 is welded to a second end (not shown), in use lower end, of the inner screen 14. A first end 26, in use upper end 26, of the base swivel 24 is attachable e.g. via a latch (not shown) to a second end 28, in use lower end 28, of the outer screen 12 to allow for minimal torque rotation of the inner screen 14. The first end 26 of the base swivel 24 and thus the lower end 28 of the inner screen 14 will normally remain stationary since the base swivel 24 has relatively high internal friction, but the minimum torque rotation feature has the advantage that the first end 26 and thus the lower end 28 of the inner screen 14 can rotate if the electrohydraulic actuator becomes stuck because, for example, sand is causing the upper end 19 of the inner screen 14 to stick. This feature prevents the electrohydraulic or electromagnetic actuator from burning out Alternatively the overtorquing can be restrained by frictionless bearings and the swivel, thereby preventing the motor from burning out.

Returning to FIG. 1*a*, the outer screen (not shown) and the inner screen 14 are provided with an interwoven lattice of outer screen shroud (not shown) and inner screen shrouds 30 respectively. Each shroud comprises a series of longitudinally arranged bands of material, such as steel of is different grades selected in accordance with the well conditions. The bands are coated with micro-electromechanical system sensors (not shown) wherein each sensor is electronically linked to a control system (not shown). The respective lattice of outer screen shroud (not shown) and inner screen shrouds 30 comprise a series of longitudinally arranged bands of material 301 which are spaced apart around the circumference of the respective outer 12 and inner 14 screens and extend parallel to the longitudinal axis of the screen system 5. Additionally, the respective lattice of outer screen shroud (not shown) and inner screen shrouds 30 comprise a series of transversely arranged rings of material 30*t* which are spaced apart along the longitudinal axis of the screen system 5 and which are arranged to lie on planes perpendicular to the longitudinal axis of the screen system 5.

Accordingly, there are a plurality of slots 32 provided in the interstices between the longitudinally arranged bands of material 301 transversely arranged rings of material 30*t*, where the size of the slots 32 of the inner screen 14 can be varied whilst the screen system 5 is in situ in the well, as will be described subsequently.

Accordingly, operation of the electrohydraulic actuator rotates the upper end 19 of the inner screen 14 relative to the lower end 28 of the inner screen 14, which results in variation of the size of the plurality of slots 32 of the inner screen 14.

FIG. 2 is a block diagram of the architecture of a system for controlling the screen system 5. The micro-electromechanical system sensors of the screen system 5 are electronically linked to a measurement system 40 which is in turn connectable to a monitoring system 42 and an adaptive controller 44. The adaptive controller 44 is also provided with input data 46 relating to a desired value of a measurable variable of the screen system 5. The adaptive controller 44 is further connected to the screen system 5 and the monitoring system 42.

FIG. 3 is a flow chart of the processes occurring within the screen system 5 and control system. In a first step 50 well data, production data, reservoir data, screen sensor data and default data are entered into a computer. The well data comprises details of:

(I) the geometrical configuration of the well, (ii) the type of completion of the well, (iii) the designed screen O.D. and (iv) gravelpack details if the well employs gravelpack completions.

The production data comprises details of the production rate and flowing bottom hole pressure. The reservoir data comprises details of the reservoir pressure, porosity, permeability and sand grain size distribution. The screen sensor data comprises details of the fluid flow velocity across the screen system, the pressure drop across the screen system and solids concentration across the screen system. The default data comprises the default screen pressure drop and the default maximum tolerance level for solids production.

In second step 52 the outer screen slot is pre-set to a standard gauge based on Saucier rule for the particular reservoir sand size distribution. In other words, the outer screen shroud lattice is pre-set prior to introduction of the screen system into the well such that the slots or gaps 32 provided between the longitudinally arranged bands of material 301 and transversely arranged rings of material 30*t* are set to the required size. In a third step 54 an optimum slot size 32 is computed for a given production rate and solids level. In a fifth step 56 the electrohydraulic actuator is instructed by the control system to rotate the inner screen 14 to a desired angle id order to increase or decrease the area of the slots or gaps 32 in the inner screen 14 through which the fluid from the well can flow. In a sixth step 58 the flow through the screen system 5 and the solids loading on the screen system 5 are continuously monitored by the micro-electromechanical sensors and in a further step 60 compared with the default maximum tolerance level for solids production and the default plugging pressure drop across the screen system 5 which have been computed in accordance with the built in classic models and entered into the computer in stage 50.

Any difference between the measured variables and the default values of the variables is communicated to the adaptive controller which in a further step 62, accordingly activates the electrohydraulic actuator to operate the screen system 5 to minimise the difference between the measured data and the default data. Thus, the electrohydraulic actuator operates the screen system 5 to adjust the slot or gap size 32 of the inner screen 14 in accordance with the output of the adaptive controller, wherein rotation in one direction, for example a clockwise direction, of the upper end 19 relative to the lower end 28 reduces the slot size 32 such that the area through which the production fluids can flow is reduced which will reduce the production fluid flow rate. Conversely, rotation of the upper end 19 relative to the lower end 28 in the other direction, for example a counter-clockwise direction, increases the slot size 32 of the inner screen 14 such that the area through which the production fluids can flow is increased which will increase the production fluid flow rate.

The adaptive controller calculates an appropriate control action by way of a solids production prediction model and a plugging tendency model. The solids production prediction model is based upon the principal that the degree of solids production or migration through a downhole solids control system depends upon the bridging effectiveness of the control system whether the control system be gravelpack or barefoot screen.

The degree of solids production or migration through a downhole solids control system is a function of a number of variables including:

1. The formation of grain size distribution, shape and density.
2. The type and properties of reservoir fluid.
3. The fluid production rate or injection rate
4. The overall well drawdown.
5. The accumulative production
6. The hole angle
7. The type of completion.

Accordingly the solids production is computed from an established mechanistic prediction model.

Using a set of equations the maximum and minimum grain size invading the screen system 5 can be computed from a given bridging efficiency. The maximum and minimum grain size invading the screen system 5 can be employed with the solids production concentration in a modified Ergun equation for predicting the flow through the filtration system. The plugging tendency model accounts for the effect of time cumulative production and pore blocking mechanisms on the flow filtration system. In the plugging tendency model the plugging tendency is quantified as a function of the pressure drop across the screen system 5, wherein the pressure drop across the screen system 5 is calculated as the sum total of the pressure drop across the screen aperture 32 itself and the pressure drop across the solid filter cake on the screen system 5.

The invention is not limited by the examples hereinbefore described which may be varied in construction and detail. For example, an outer screen could be omitted, with just an inner screen operating to control the sand production in this embodiment, the control system would be modified accordingly.

The invention claimed is:

1. A screen system for underground wells, the screen system comprising a screen wherein the screen comprises a plurality of slots; and a mechanism capable of varying the size of the said slots, the mechanism comprising a motorised actuator.

2. A screen system according to claim 1, wherein the screen system comprises a pair of screens comprising a slotted inner screen disposed within a slotted outer screen.

3. A screen system according to claim 2, further comprising at least one external screen shroud.

4. A screen system according to claim 3, wherein at least one screen or screen shroud is provided with electromechanical sensors.

5. A screen system according to claim 4, wherein the inner screen is rotated under the control of a controller which is further connected to the electromechanical sensors.

6. A screen system according to claim 5, wherein the controller employs a solids prediction model to calculate a control action.

7. A screen system according to claim 5, wherein the controller further employs a plugging tendency model to calculate a control action.

8. A screen system according to claim 3, wherein the external screen shroud is attachable to the outer screen.

9. A screen system according to claim 8, wherein the external screen shroud is perforated.

10. A screen system according to claim 2, wherein the inner screen is rotatable relative to the outer screen.

11. A screen system according to claim 2, wherein the inner screen comprises a substantially cylindrical member having a pair of ends wherein one end is rotatable relative to the other end by operation of the said mechanism.

12. A screen system according to claim 2, wherein at least one of the inner and outer screens comprises a plurality of longitudinally arranged members and at least one transversely arranged member which combine to provide the slots in the interstices therebetween.

13. A screen system according to claim 7, wherein rotation of one end of the said at least one screen causes an end of the longitudinally arranged members to rotate relative to the other end of the longitudinally arranged members such that the slot size is capable of being varied.

14. A method of fluid flow control and/or sand production control in a well, the method comprising the steps of placing a screen having a plurality of slots in the well and varying the size of the slots by means of a mechanism comprising a motorised actuator.

15. A method according to claim 14, wherein the mechanism is capable of rotating a first portion of the screen relative to a second portion of the screen to vary the size of the said slots.

16. A method according to claim 15, wherein a controller controls the actuation of the rotation mechanism.

17. A method according to claim 16, wherein the controller is provided with data inputs from one or more sensors provided downhole.

18. A method according to claim 17, wherein the sensors are mounted on one or more portions of the screen system.

19. A method according to claim 17, wherein the sensors are electromechanical sensors.

20. A method according to claim 16, wherein the controller employs a solids prediction model to calculate a control action.

21. A method according to claim 20, wherein the controller further employs a plugging tendency model to calculate a control action.

* * * * *

UNITED STATES PATENT AND TRADEMARK OFFICE

CERTIFICATE OF CORRECTION

PATENT NO. : 7,389,819 B2
APPLICATION NO. : 10/526887
DATED : June 24, 2008
INVENTOR(S) : Mufutau Babs Oyeneyin and Asher Mahmood It is certified that error appears in the above-identified patent and that said Letters Patent is hereby corrected as shown below:

Col. 6, line 36, Claim 13 should read as follows:

13. A screen system according to claim 12, wherein rotation of one end of the said at least one screen causes an end of the longitudinally arranged members to rotate relative to the other end of the longitudinally arranged members such that the slot size is capable of being varied.

Signed and Sealed this

Second Day of September, 2008

JON W. DUDAS
*Director of the United States Patent and Trademark Office*